United States Patent [19]

Tison

[11] 4,252,058

[45] Feb. 24, 1981

[54] WOOD TRUSS FORMING APPARATUS

[76] Inventor: Harley R. Tison, 409 Orchard St., Oswego, Ill. 60543

[21] Appl. No.: 21,576

[22] Filed: Mar. 19, 1979

[51] Int. Cl.[3] ..... B30B 3/00

[52] U.S. Cl. ..... 100/173; 100/DIG. 13; 227/152; 269/910; 269/289 MR

[58] Field of Search ..... 100/DIG. 13, 153, 155, 100/173, 176; 227/152; 269/321 F; 144/288 C

[56] References Cited

U.S. PATENT DOCUMENTS

| | | | |
|---|---|---|---|
| 3,172,125 | 3/1965 | Sanford | 100/DIG. 13 |
| 3,375,778 | 4/1968 | Newman | 100/DIG. 13 |
| 3,925,870 | 12/1975 | Adams | 100/DIG. 13 |
| 4,063,498 | 12/1977 | Labellarte | 100/DIG. 13 |

*Primary Examiner*—Billy J. Wilhite

*Attorney, Agent, or Firm*—Wallenstein, Spangenberg, Hattis & Strampel

[57] ABSTRACT

Apparatus for forming a wood roof truss, or the like, comprising a system which includes a wood member positioning and upper fastening means engaging station for arranging and maintaining wood members in positions corresponding to the ultimate positions of the wood members in the completed truss, a fastening means embedding station for permanently anchoring upper and lower fastenings means in the wood members to fix the wood members in their ultimate positions with respect to one another, and a wood roof truss stacking station for automatically moving a completed wood roof truss from a substantially horizontal position to an upright position. The wood member positioning and upper fastening means engaging station includes wood member receiving means having associated therewith unique truss elevating and advancing means for quickly and simultaneously raising the partially fixed wood members of the truss, thereby enabling the wood members to be rapidly moved, as a unit, to the next station in the system. The system requires minimal operating personnel, and eliminates the need for any manual lifting of a truss by such personnel.

10 Claims, 33 Drawing Figures

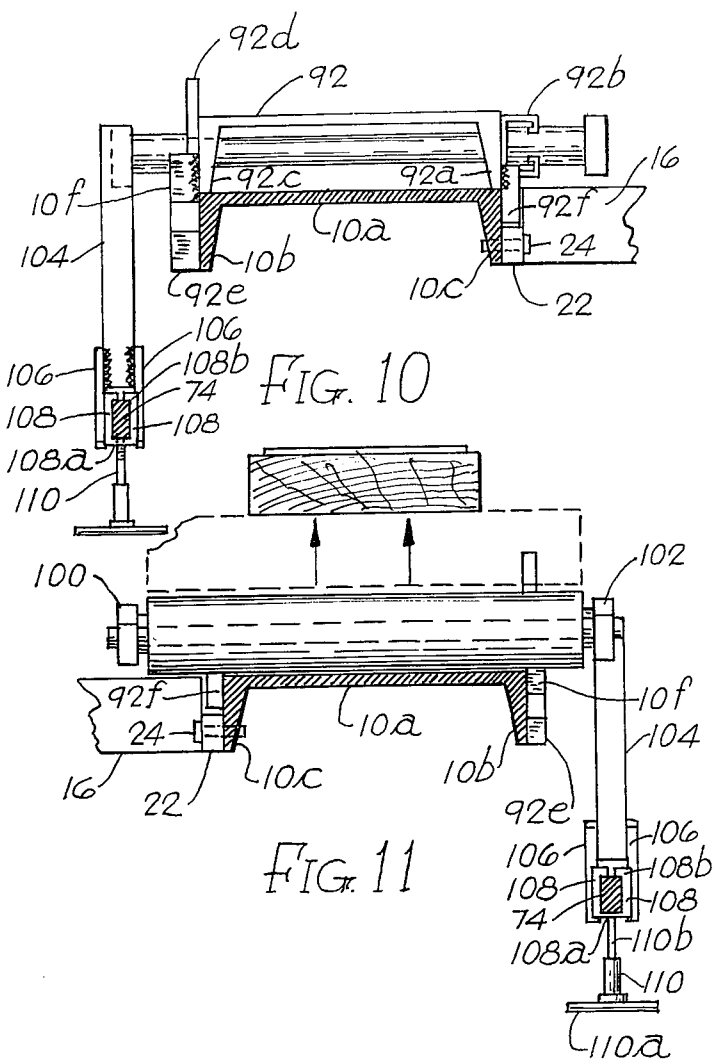
FIG. 10
FIG. 11
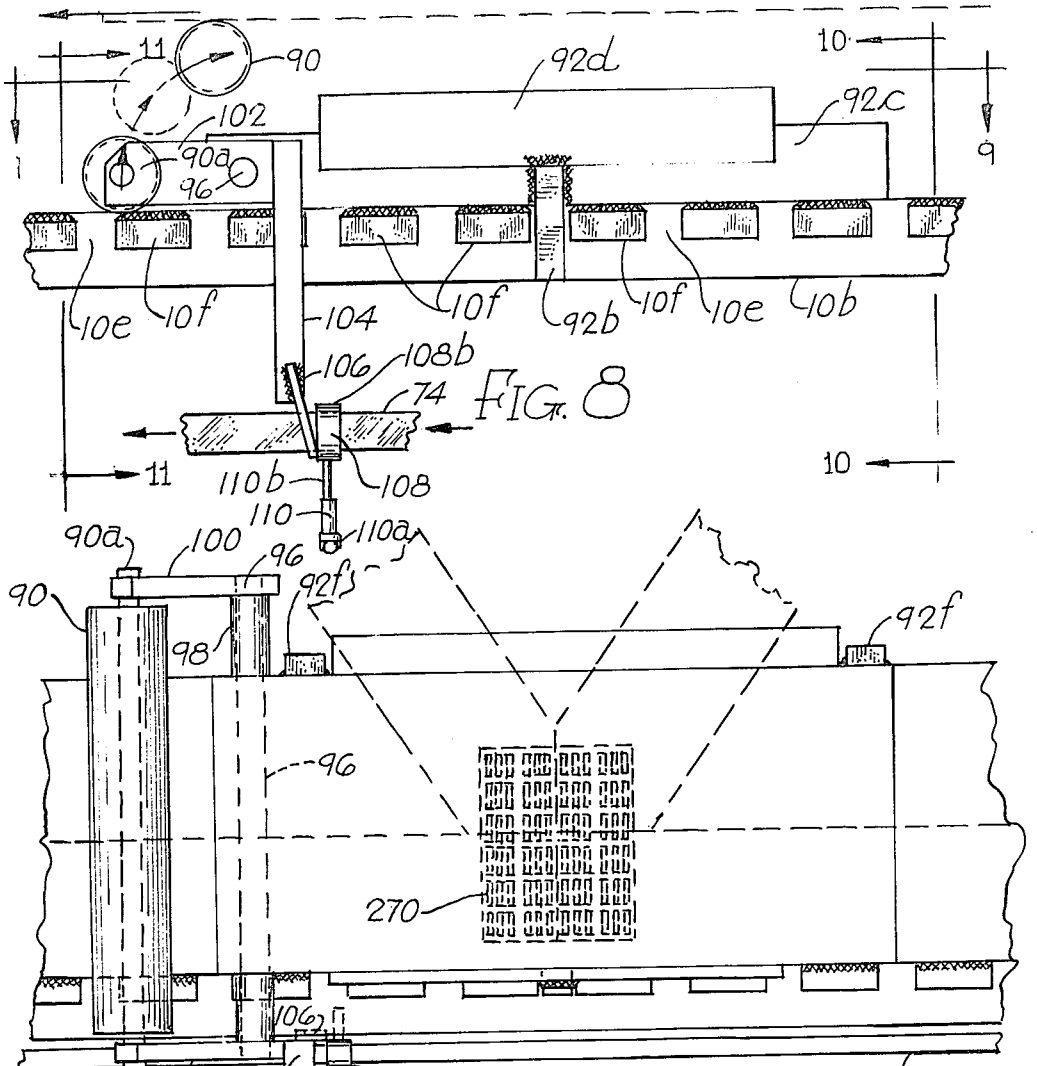
FIG. 8
FIG. 9

WOOD TRUSS FORMING APPARATUS

The present invention, in one of its aspects, relates to apparatus comprising a high-speed, in-line system for making wood roof trusses, or the like, and in another of its aspects, to wood member receiving and positioning means having associated therewith truss elevating means for automatically raising partially secured wood members from the wood member receiving and positioning means whereby the partially secured wood members can be easily and readily moved as a unit in a desired direction to the next station in the system.

Heretofore, machines employed in the fabrication of wood roof trusses, whether the trusses be of the hip, shed, fan, pratt, monopitch, fink, bowstring, scissors, king-post, agra, cambered, flat, or the like, type, generally speaking, require handling by at least three workmen, and, in the case of large trusses such as agra or attic trusses, upwards of five or six workmen are needed to handle a truss. Wholly apart from the higher costs involved as a result of the number of operating personnel required, certain of these prior machines utilize relatively complex means such as hydraulically operated clamps to position nail plates above and below the joints between the wood members used to form the truss. Others of these machines require that the operating personnel, after attaching the upper nail plates on the wood members, turn the truss completely over to enable a second series of nail plates to be attached. In either case, the opportunity for injury to operating personnel has made it necessary for companies using such machines to carry high premium insurance to protect themselves against personal injury claims, thereby significantly adding to the cost of operating the machines. In addition to the foregoing shortcomings of conventional wood roof truss forming machines, they generally require considerable space and headroom to enable operating personnel to perform the various operations necessary to complete a truss. Thus, a larger, and, therefore, more costly physical plant is needed to house the machines.

In accordance with one aspect of the present invention, apparatus comprising a high-speed, in-line wood roof truss forming system has been evolved which eliminates the need for operating personnel to lift, turn or carry a truss regardless of the size of the truss. As a result, a wood roof truss of substantially any size and configuration can be fabricated with the apparatus by only two workmen. What is more, the entire operation, from the initial positioning of the wood members comprising the truss, to the stacking of the completed truss, can be carried out in a matter of minutes with minimal effort upon the part of operating personnel, and under the safest working conditions. The apparatus comprising the system, moreover, is arranged in a manner so that minimum space and headroom are required for its operation.

In brief, the wood roof truss forming apparatus of this invention comprises a first, wood member positioning station for arranging wood members in positions corresponding to the ultimate positions of the wood members in the completed truss. Also at the positioning station, upper fastening means, preferably in the form of nail plates, are partially embedded in the wood members at the abutting ends or joints thereof to secure the wood members into a loosely integrated unit. In accordance with another aspect of this invention, the wood member positioning station includes unique truss elevating and advancing means for quickly and positively raising the loosely secured wood members, as a unit, and enabling them to be moved to a second station where lower nail plates are first partially secured at the joints of the wood members in opposed relation to the upper nail plates, and then, along with the upper nail plates, are permanently anchored in the wood members.

The truss elevating and advancing means, in a preferred embodiment of the invention, comprises a plurality of automatically operable truss elevating rollers which can be individually and selectively moved from a normally inoperable position to an operable position. The configuration of the truss to be formed determines which of the truss elevating rollers are moved to an operable position. More specifically in this connection, the truss elevating rollers are positioned along spaced supports or bridges which extend outwardly from one side of an elongated side or bottom chord rail, and which underlie adjustable, hinged upper or top chord rails. The bottom chord rail is provided with movable wood member support means having automatically operable truss elevating rollers associated therewith. In addition, at least one of the upper rails is provided with automatically operable truss elevating means inwardly of the hinged end thereof. The automatically operable truss elevating rollers which underlie the wood members forming the web or struts between the upper and lower chords of the truss are positioned in an operable position, and, in cooperation with the automatically operable truss elevating rollers associated with the movable wood member support means carried on the bottom rail and on at least one of the upper or top chord rails, act to raise the wood members, as a unit, after they have been partially secured together at their joints, to a level whereby they can be moved to the next station in the system without the need for any lifting of the wood members by operating personnel. In addition to the truss elevating rollers which make contact with the wood members forming the web or struts of the truss, other truss elevating rollers positioned on bridges located between the wood member positioning and upper fastening means engaging first station and the lower fastening means engaging and embedding second station, are simultaneously automatically operated to form a conveyor along which the partially secured wood members are moved from the first station to the second station.

At the second station, one of the operators partially embeds a lower nail plate in each of the joints of the wood members in opposed relation to the upper nail plates. As the lower nail plates are thus embedded, the operator progressively advances the truss between nail plate embedding means which, in the preferred embodiment of the invention comprises press rollers, whereby the upper and lower nail plates are securely and permanently embedded in the wood members which form the truss. The press rollers move the finished truss, while it is still in a horizontal position, to a third or truss stacking station. The stacking station advantageously includes a plurality of spaced conveyor rollers at least some of which are mechanically driven. The conveyor rollers at the stacking station advance the finished truss to a point where the truss engages switch means which energizes drive means for raising a plurality of elongated, finger-like truss-elevating members positioned between the rollers at the stacking station. The finger-like members raise the finished truss to a substantially vertical position and move the truss off of the conveyor rollers at the stacking station onto inclined truss support members located to the side of the conveyor rollers. Thus, no lifting of the truss by the operators is required at any of the three stations comprising the system. After a predetermined number of trusses have been stacked on the inclined truss support members at the third station, the trusses are bound together with, for example, metal straps, and are then removed with a forklift truck, or the like, for shipment to a building site.

The foregoing, and other features and advantages of the apparatus of the present invention will become clear upon reference to the accompanying description, claims and drawings wherein:

FIG. 8 is a fragmentary, enlarged side view in elevation of a bottom chord support member having a roller for elevating the bottom chord of a truss at station 1 of the system;

FIG. 10 is an end view, partly in section, taken substantially along line 10—10 of FIG. 8;

FIG. 11 is a fragmentary end view, partly in section, taken substantially along line 11—11 of FIG. 8;

Figure 1:
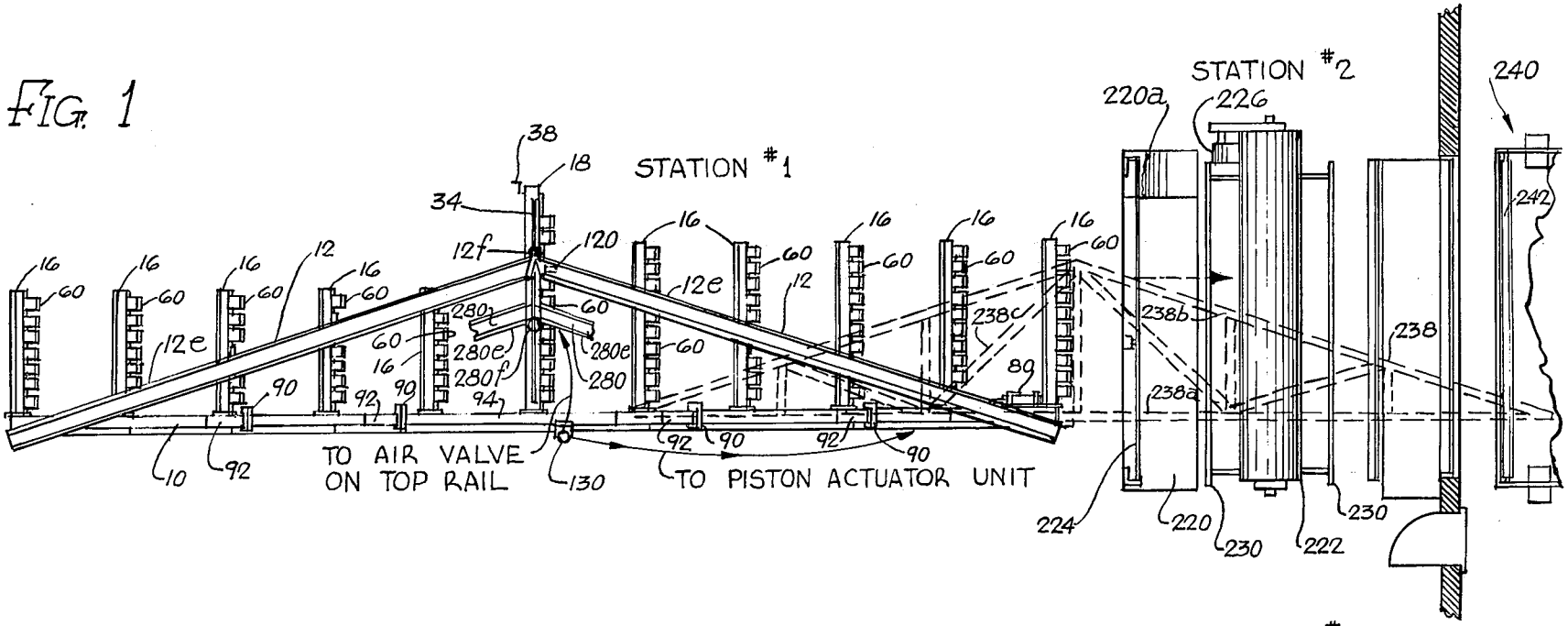
FIG. 1 is a plan view of the first and second stations of the truss assembly system of the present invention.
Figure 2:
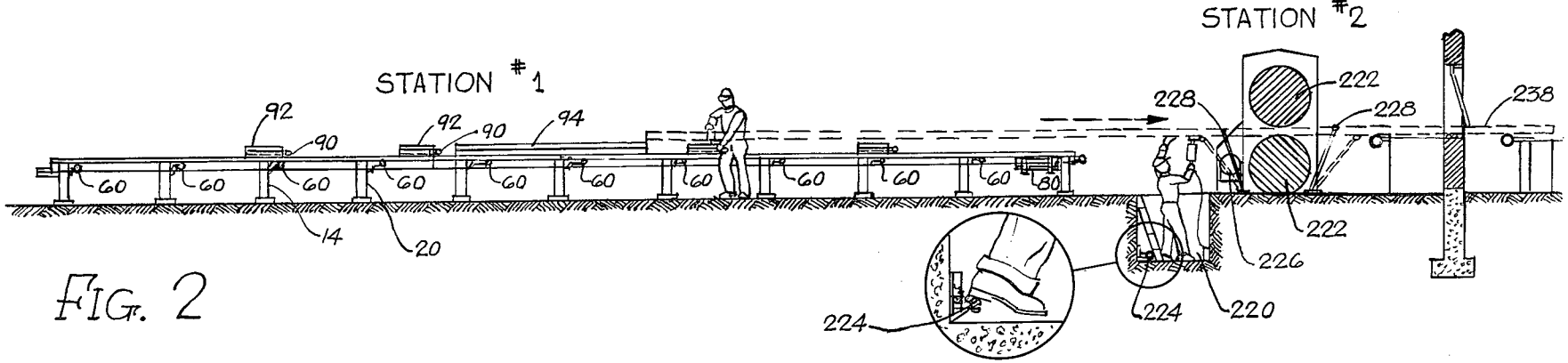
FIG. 2 is a side view in elevation of said stations.
Figures 3, 4, 5:
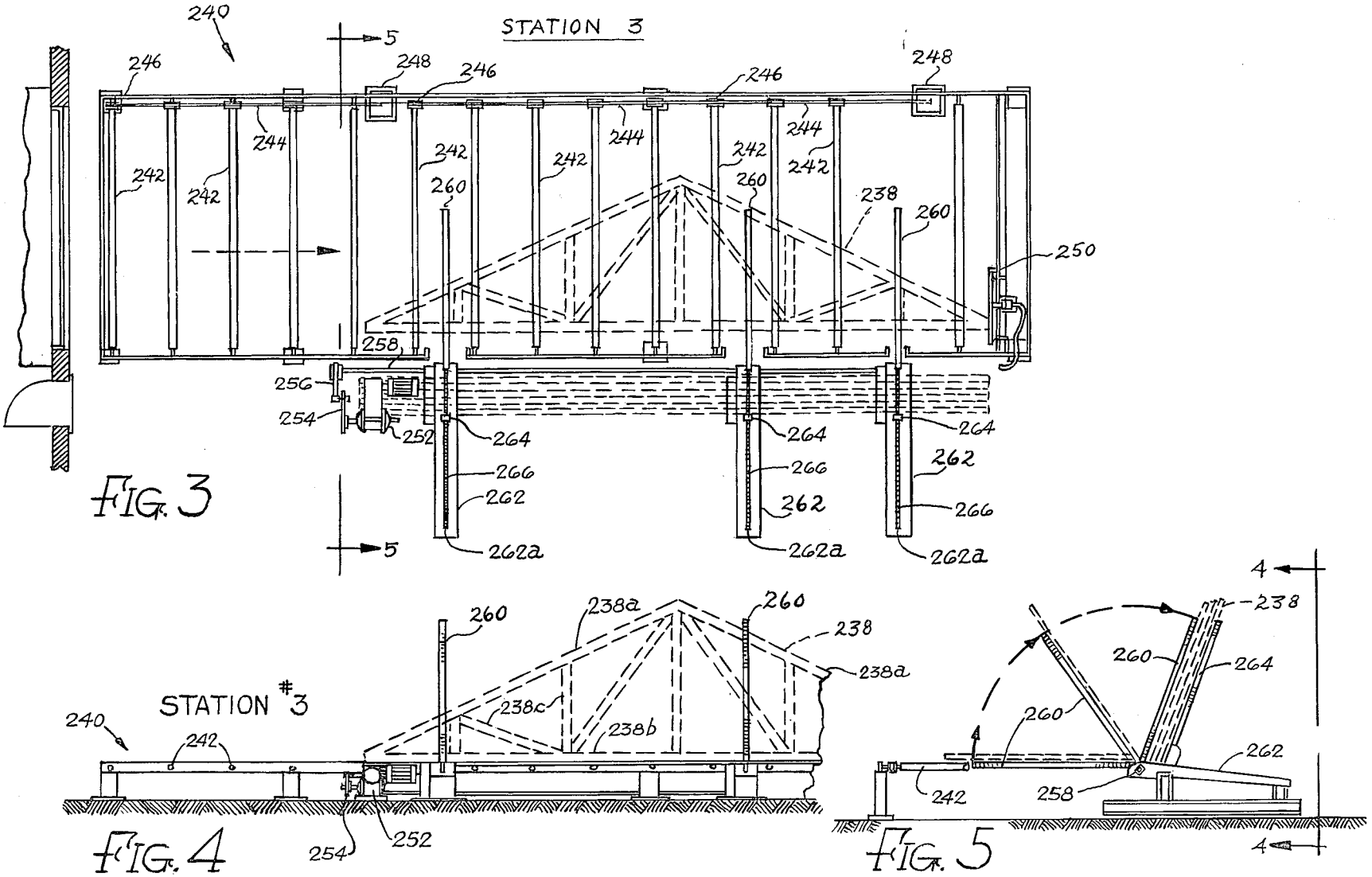
FIG. 3 is a plan view of the third or stacking station of the system.
FIG. 4 is a fragmentary side view in elevation as viewed along line 4—4 of FIG. 5 showing a completed truss being stacked at the third station.
FIG. 5 is an end view of the stacking station as viewed substantially along line 5—5 of FIG. 3.

Referring, now, in detail to FIGS. 1, 2 and 3 of the drawings, the preferred embodiment of the apparatus illustrated comprises a wood member positioning station 1, a fastening means embedding station 2, and a finished truss stacking station 3. The apparatus comprising the stations 1, 2 and 3 advantageously is arranged in-line to form a continuous system, and enables the wood members used in forming a truss to be maintained in a horizontal position throughout their movement through the stations 1, 2 and 3. The only point at which the horizontal orientation of the wood members is altered is at station 3 where stacking of the finished truss is achieved automatically.

The apparatus at station 1 of the system comprises an elongated, stationary bottom chord rail 10, and a pair of movable top chord rails 12—12 which are hinged at their inner ends. The rails 10 and 12—12 desirably are formed of steel channel beams. The rail 10 is supported by a plurality of spaced standards or legs 14, and has an upper wall **10*a*, and a downwardly extending outer wall 10*b* and inner wall 10*c*. The rails 12—12, like the rail 10, each has an upper wall 12*a*, and a downwardly extending outer wall 12*b* and inner wall 12*c*. (See FIGS. 10–12**).

An elongated outwardly extending channel member **12*d* is secured to the inner wall 12*c* of each of the top chord rails 12—12. The outer wall 12*b* of each of the rails 12—12, in turn, is provided with an upwardly extending, chord positioning wall or member 12*e*. The function of the members 12*d* and 12*e*** will become clear as the description proceeds.

Figures 6, 7, 9, 12, 15, 16, 20, 25, 28, 29:
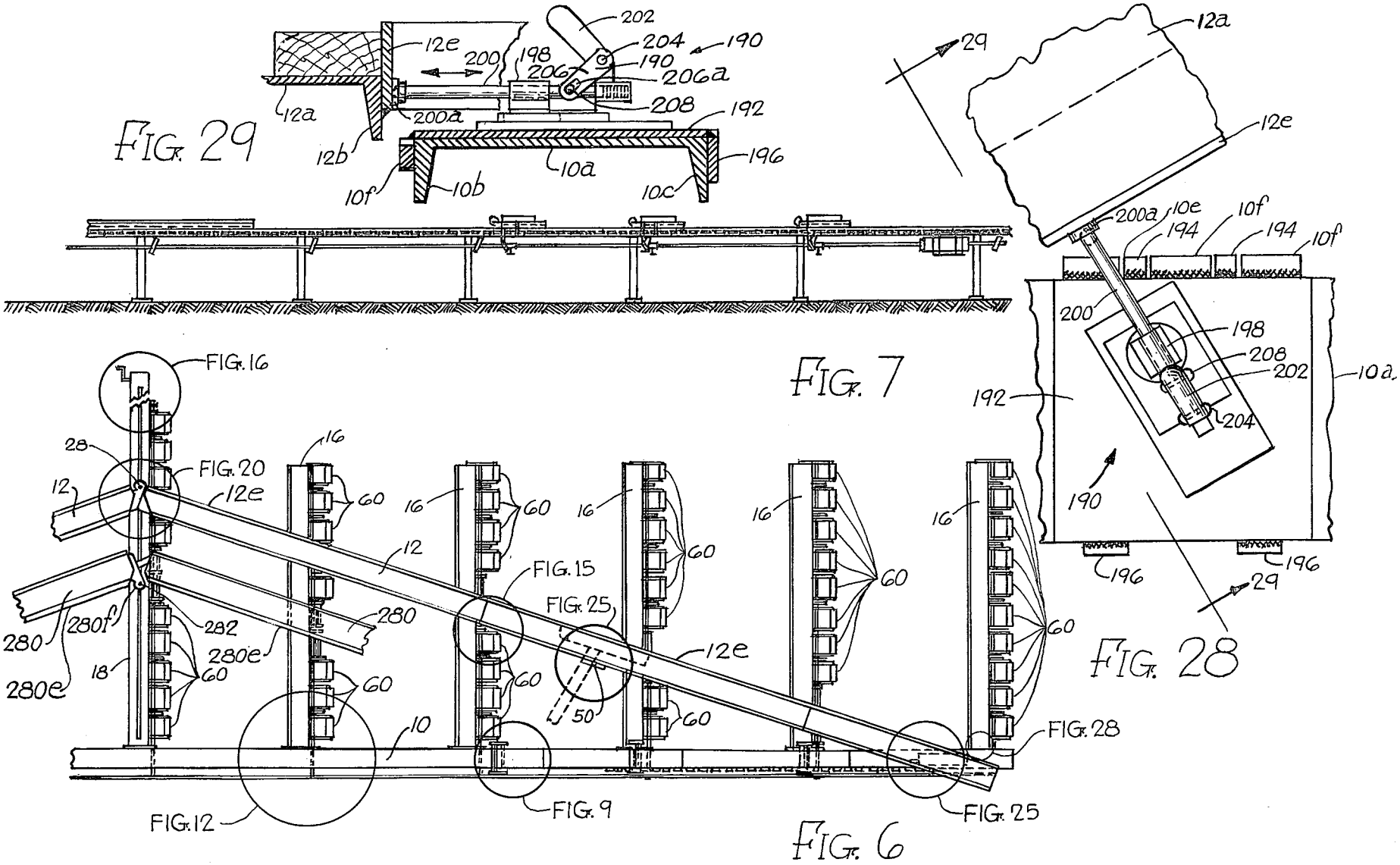
FIG. 6 is a fragmentary enlarged plan view corresponding to the view of FIG. 1 of station 1 of the system.
FIG. 7 is a fragmentary side view in elevation corresponding to the view of FIG. 6.
FIG. 9 is a plan view, taken at the point encircled in FIG. 6, and as viewed along line 9—9 of FIG. 8, of the bottom chord support member and showing in dotted lines a nail plate partly embedded at the joints formed between the bottom chord and two struts of a truss.
FIG. 12 is taken at the area encircled in FIG. 6, and is a fragmentary side view, partly in section, showing one of the truss elevating and engaging rollers being moved upwardly to engage a strut of a truss.
FIG. 15 is a fragmentary side view taken at the area encircled in FIG. 6, partly in section, showing, in side-by-side relation, an idle truss engaging and elevating roller and an operable truss engaging and elevating roller.
FIG. 16 is a fragmentary top plan view taken at the area encircled in FIG. 6 showing the crank and chain drive for moving the pivotally hinged top chord rails of the apparatus at station 1 of the system.
FIG. 20 is a fragmentary end view, partly in section, as viewed substantially along line 20—20 of FIG. 19.
FIG. 25 is a fragmentary plan view of the area encircled in FIG. 6 showing guide means on one of the top chord rails for positioning a wood member comprising the lower chord of the truss in proper position.
FIG. 28 is a view taken in the area encircled in FIG. 6 showing stabilizing means for maintaining the free end of the top chord rails in proper position with relation to the bottom chord rail of the apparatus.
FIG. 29 is a fragmentary view in section taken substantially along line 29—29 of FIG. 28.
Figures 16, 17, 17A, 18, 19, 20, 20A, 20B, 20C, 21, 22:
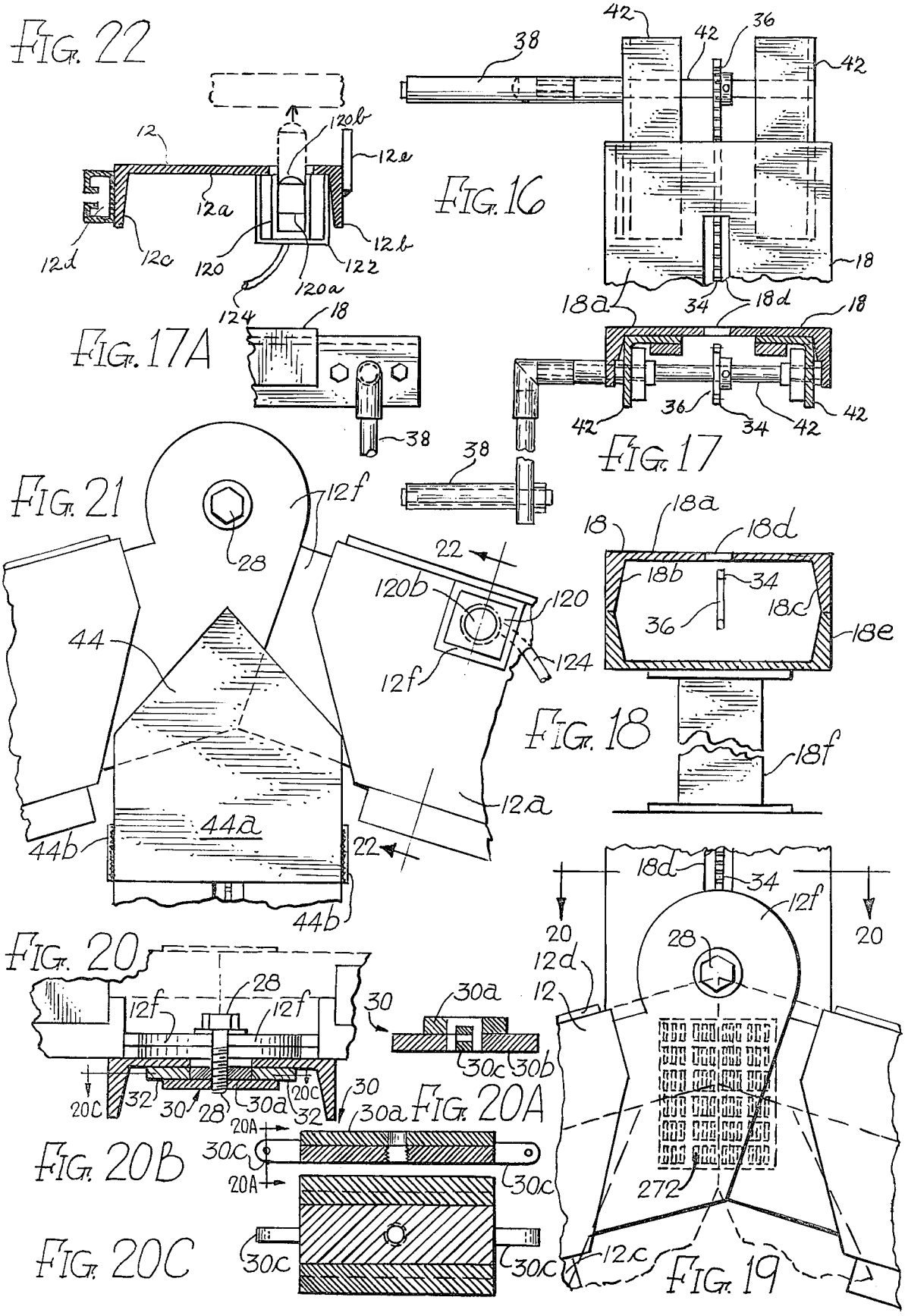
FIG. 17 is a fragmentary end view, partly in section, of the crank and drive means illustrated in FIG. 16.
FIG. 17A is a fragmentary side view of the crank handle used to drive the chain mechanism shown in FIGS. 16 and 17.
FIG. 18 is a fragmentary end view, partly in section, of the chain drive used to move the top chord rails to a preselected position as viewed in the direction opposite to that of FIG. 17.
FIG. 19 is a fragmentary plan view showing the pivotally hinged top chord rails which are movable by the chain drive mechanism shown in FIGS. 16 and 17.
FIGS. 20A, 20B and 20C are enlarged sectional views of the chain driven linkage carried on the pivot bolt of the pivotally hinged chord rails.
FIG. 21 is a fragmentary plan view of the pivotally hinged top chord rails, and showing auxiliary truss engaging and elevating means carried on one of the top chord rails.
FIG. 22 is an end view, partly in section, taken substantially along line 22—22 of FIG. 21.

Extending outwardly from the inner wall 10*c* of the bottom chord rail 10, below the horizontal plane of the top chord rails 12—12, are a plurality of bridges 16, including an elongated centermost bridge 18, each of which is supported adjacent to its free or outermost end by a floor mounted standard or leg 20, and at its innermost end by a spacer bar 22 secured by bolts 24—24 engaged in the inner wall 10*c* of the bottom chord rail 10. The bridges 16 and 18 advantageously are fabricated of a steel channel beam thereby providing the bridges 16 with an upper wall 16*a* and side walls 16*b* and 16*c*, and the bridge 18 with an upper wall 18*a* and side walls 18*b* and 18*c*. As shown in FIG. 18, the bridge 18 is supported intermediate its ends by an inverted channel beam 18*e* which is secured on a standard of leg 18*f*. The upper wall 18*a* of the bridge 18 has an elongated slot 18*d* therethrough for receiving a bolt 28 which serves as a pivot pin for hinge elements 12*f*—12*f* provided on the inner end of each of the top chord rails 12—12. (See FIGS. 20-20*c*). The threaded end of the bolt 28 is received in a tapped bore in a chain operated rail guide and locking member 30. The member 30 has an upwardly extending guide portion 30*a* which is joined to a lower chain lug carrying and locking portion 30*b*. The guide portion 30*a* is in movable engagement with the side walls of two guide bars 32—32 secured to the inner surface of the top wall 18*a* of the bridge 18 along the slot 18*d* formed therethrough. The lower portion 30*b* of the member 30 has a chain lug 30*c* provided on each side thereof for engagement with a drive chain 34 mounted on sprockets 36—36 positioned at each end of the bridge 18. As shown in FIGS. 16, 17 and 17A, the chain 34 is driven manually by means of a handle 38 connected to a shaft 42 on which one of the sprockets 36 is mounted. The ends of the shaft 42 are journaled in openings provided in a pair of angle irons 42—42 secured to the inner surface of the upper wall 18*a* of the bridge 18. In order to move the hinged ends of the top chord rails 12—12 along the bridge 18, the bolt 28 is first loosened to enable the rail guide and locking member 30 to be driven by the chain 34 by turning the handle 38 in the desired direction. When the hinged ends of the rails 12—12 have reached a preselected position on the bridge 18, the bolt 28 is turned to bring the portion 30*b* of the member 30 into snug engagement with the guide bars 32—32 thereby locking the inner ends of the top chord rails 12—12 in position. As best shown in FIG. 21 of the drawings, a support member 44, having a pointed top plate 44*a* and depending bridge-engaging side walls 44*b*—44*b* is slidably carried on the bridge 18. The member 44 provides a support base for the joint formed by a king post and the top chords of a king post truss when the apparatus is used for fabricating such a truss.

Referring, now, in particular, to FIGS. 12 and 15 of the drawings, each of the bridges 16 has an elongated channel member 16*d* secured to the side wall 16*c* thereof. The channel members 16*d*, as well as the channel members 12*d* on the top chord rails 12—12, are adapted to support movable upwardly extending strut positioning pins 50 (see FIG. 15). The pins 50 are secured to an outer plate 50*a* which is bolted to a clamp 50*b* slidably engaged in the channel 12*d* or 16*d*, as the case may be.

Positioned in side-by-side relation on the side wall 16*b* of the bridges 16, as well as on the side wall 18*b* of the slotted bridge 18, are a plurality of wood member engaging and elevating rollers 60. Each of the rollers 60 is freely swingably mounted by means of a tubular member 60*a* on a cylindrical shaft 62. The spindle 60*b* of the rollers 60 are supported in openings provided at the ends of a pair of outwardly extending arms 60*c*—60*c* secured to the ends of the bearing or tubular member 60*a*. A reinforcing rod 60*d* desirably is welded to the arms 60*c*—60*c* inwardly of the roller 60.

The shaft 62 extending along the side wall of each of the bridges is mounted for rotation in openings provided through a plurality of outwardly extending spaced ears or projections 64 secured to the side wall 16*b* of the bridges 16 and the side wall 18*b* of the slotted bridge 18. The shaft 62, as clearly shown in FIGS. 12, 13 and 14, extends under the side walls 10*b* and 10*c* of the bottom chord rail 10, and is received in an opening provided in an extension 66 secured to the bottom of the side wall 10*b* of the rail 10. The end of the shaft 62 projects outwardly from the side wall 10*b* of the rail 10 and is fixedly engaged in an opening at the end of a lever arm 68. The other end of the arm 68 is movably secured by a pivot pin 70 in a vertically elongated opening 72*a* formed in a downwardly extending plate member 72 secured to the bottom edge of a rectangularly shaped main drive rod 74 connected to the piston of an air cylinder 80 positioned at the end of the bottom chord rail 10 adjacent station 2 of the truss assembly system. (See FIGS. 1 and 2).

Figures 12, 13, 14, 15:
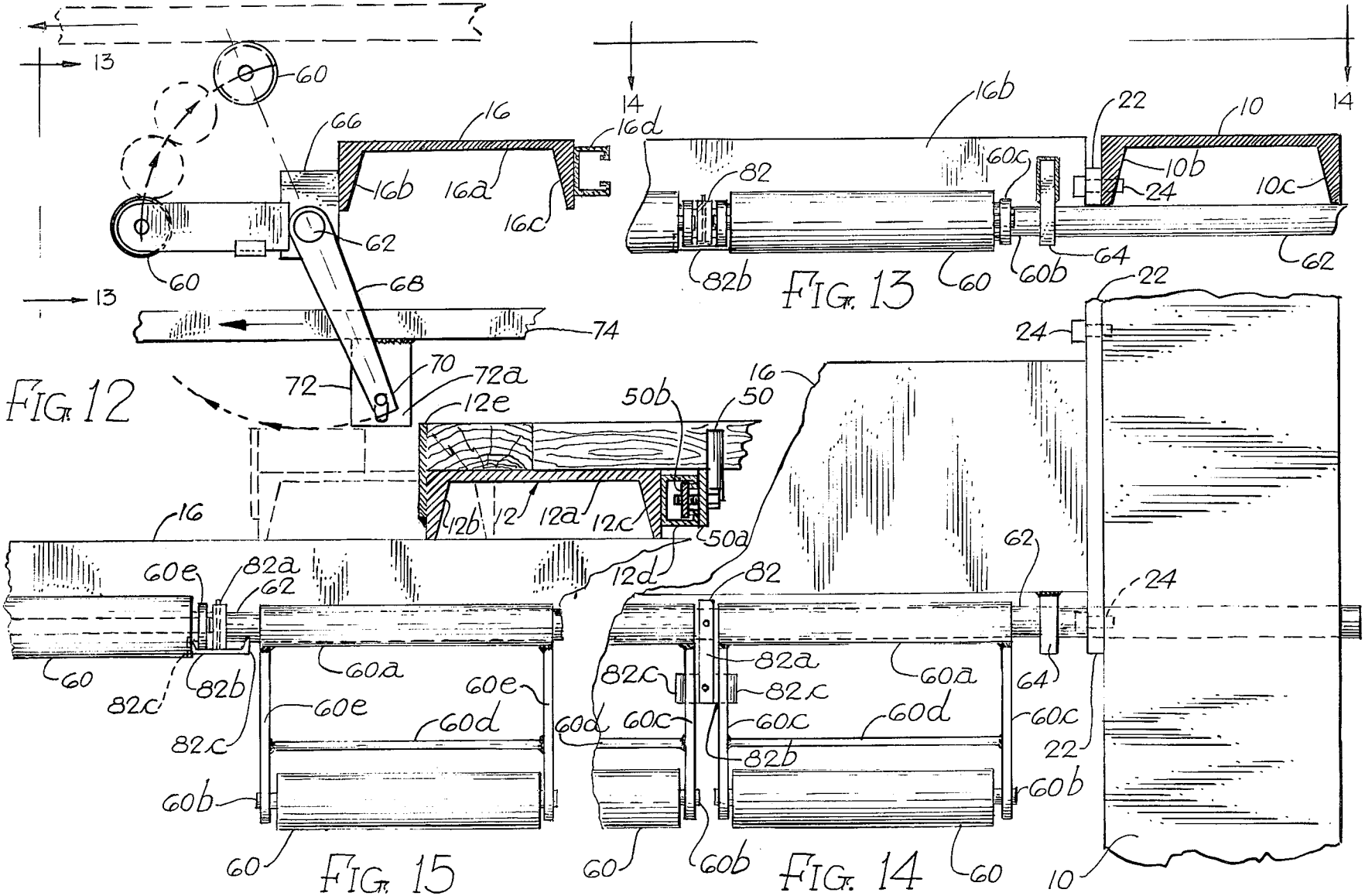
FIG. 13 is a fragmentary end view as viewed substantially along line 13—13 of FIG. 12.
FIG. 14 is a fragmentary plan view showing the manner in which the truss engaging and elevating rollers are mounted on the bridges.

As indicated hereinabove, the rollers 60, normally, are freely swingable on the shaft 62. To enable the rollers 60 to engage and elevate the wood members comprising a truss, T-bars 82 are secured to the shaft 62. Each T-bar comprises an outwardly extending leg portion 82*a* secured at its inner end to the shaft 62, and having a crosspiece 82*b* joined to its outer end. The crosspiece 82*b* has upwardly extending ends 82*c*—82*c* in which the arms 60*c* of adjacent rollers 60 can be cradled. The T-bars are positioned on the shaft 62 in a manner to permit each T-bar 82 to engage two rollers 60. Thus, as shown in FIGS. 14 and 15, the arms 60*c* of two adjacent rollers 60 are cradled on the crosspiece 82*b* of a single T-bar 82. In FIG. 15, only one arm 60*c* of adjacent rollers 60 is cradled in a T-bar. With the rollers 60 so arranged on the T-bars 82, the two rollers 60 as shown in FIG. 14 and the one roller 60 in FIG. 15, will be elevated to the position shown in FIG. 12 by the thrust of the drive rod 74, transmitted to the shaft 62 through the lever arm 68.

In addition to driving the rollers 60 on the bridges 16 and 18 to an elevated, wood member engaging position, the drive rod 74 also advantageously is utilized to elevate rollers 90 provided on movable bottom chord support members 92 and a stationary bottom chord support member 94 carried on the bottom chord rail 10 (see FIGS. 8-11). The members 92 and 94 desirably are formed of sections of steel channel beams, the section forming the stationary member 94 being longer than the sections forming the movable members 92, and being positioned on the rail 10 at the slotted bridge 18. The inner side wall 92*a* and 94*a*, respectively, of the members 92 and 94 are provided with an outwardly extending channel piece 92*b* and 94*b*, respectively. The outer side wall 92*c* and 94*c* of the members 92 and 94 have an upwardly extending wood member positioning wall 92*d* and 94*d*, respectively, secured thereto. The outer side wall 92*c* of each of the movable members 92 also is provided with a downwardly extending locking pin 92*e* which is adapted to be received in a preselected space 10*e* provided by a plurality of spaced bosses or teeth 10*f* secured along the outer wall 10*b* of the bottom chord rail 10. The inner wall 92*a* of each of the movable members 92 has a pair of downwardly extending stabilizing bars or pins 92*f*—92*f* secured thereon which are adapted to engage the outer surface of the inner side wall 10*c* of the rail 10.

The rollers 90 on the bottom chord support members 92 and 94 are rotated to an elevated, wood member engaging position by means of a shaft 96. The shaft 96 extends through a tubular bearing member 98 supported in openings provided in the side walls of the members 92 and 94, and the ends of the shaft 96 are engaged in openings in one end of a pair of pivotable arms 100 and 102. The ends of the spindle 90*a* of each of the rollers 90 are engaged in openings in the other end of the arms 100 and 102. The outermost arm 102 carries a downwardly extending lever arm 104 having a pair of downwardly and outwardly extending fingers 106—106 secured at the lower end thereof. The fingers 106—106 straddle the main drive rod 74, and are adapted to be engaged by the rod-engaging arms 108—108 of a clamp 110. The clamp 110, as shown, has a handle 110*a* which is joined to an externally threaded portion 110*b* which is received in a tapped opening in a base portion 108*a* joined to the rod-engaging arms 108—108 of the clamp 110. The threaded portion 110*b* acts to urge the rod 74 into snug engagement with inwardly extending legs 108*b*—108*b* of the fingers 108—108. The movable support members 92 are positioned along the bottom chord rail 10 so that they provide support for the joints between wood members which form the lower or bottom chords of a truss, and the joints between the wood members which form the struts and the bottom chords of the truss.

In accordance with a preferred embodiment of the present invention, wood member engaging and elevating means in the form of an air cylinder 120 is provided on at least one of the top chord rails 12. As shown in FIGS. 21 and 22 of the drawings, the cylinder 120 is supported on a bracket 122 positioned adjacent the inner side wall 12*b* of one of the top chord rails 12, inwardly of the hinged end thereof. The cylinder 120 has a vertically oriented piston 120*a* on the upper end of which is secured a ball roller 120*b*. An opening 12*f* is provided in the top wall 12*a* of the rail 12 to enable the piston 120*a* and its associated roller 120*b* to make contact with and raise the top chords comprising a truss above the upper edge of the wall 12*e* on the rail 12 as shown in FIG. 22. The cylinder 120 is connected by means of an air line 124 to an air valve 130 (see FIG. 1). The valve 130 serves to operate, simultaneously, both the main air cylinder 80 and the auxiliary air cylinder 120.

Figures 23, 24, 25, 26, 27:
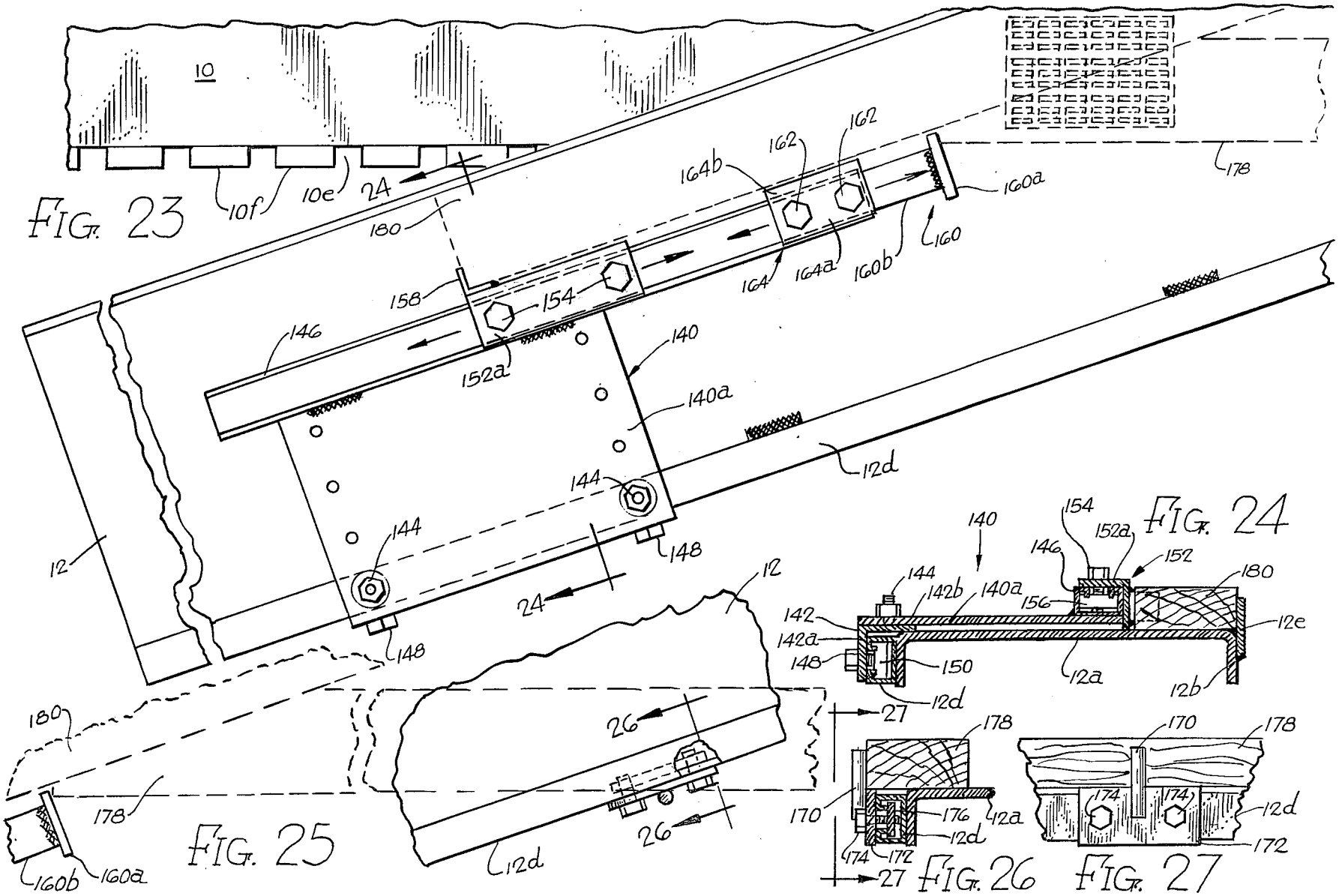
FIG. 23 is an enlarged fragmentary plan view of truss-tail engaging means secured to one of the top chord rails for positioning the wood members comprising the ends of a truss.
FIG. 24 is a sectional view taken substantially along line 24—24 of FIG. 23.
FIG. 26 is a fragmentary sectional view taken substantially along line 26—26 of FIG. 25.
FIG. 27 is a fragmentary side view in elevation of the guide means as viewed substantially along line 27—27 of FIG. 26.

As illustrated in FIGS. 23 and 24, a movable and adjustable chord tail, or end, positioning unit 140 is provided on the top chord rails 12 adjacent to the intersection of the rails 12 with the bottom chord rail 10. Each unit 140 comprises a top plate 140*a* having a downwardly extending angle iron 142 secured at the outer edge thereof, by means of bolts 144—144, and an elongated, upwardly extending channel member 146 secured along the inner edge thereof. The outer leg 142*a* of the angle iron 142 is provided with openings for receiving bolts 148—148 in threaded engagement with a clamp bar 150 positioned in the channel member 12*d* on the outer side wall 12*c* of the rail 12. The inwardly extending leg 142*b* of the angle iron 140, in part rides on the upper wall 12*a* of the rail 12. Loosening of the bolts 144 and 148 enables the unit 140 to be properly positioned with respect to the ends of the wood members comprising the outermost extremities of the top and bottom chords of a truss. The channel member 146 of the unit 140 is adapted to carry an adjustable top chord engaging member 152 having an inwardly extending leg 152*a* which overlies the channel member 146 and which is provided with a pair of bolts 154—154 in threaded engagement with a clamp bar 156 positioned in the channel member 146. The lower edge of the downwardly extending leg 152*b* of the member 152 abuts the top wall 12*a* of the rail 12, and has secured thereto a stop 158 for engaging the end of the top chord of a truss. The unit 140 also has a stop 160 for engaging the end of the bottom chord of a truss. The stop 160 has a flat end piece 160*a* carried on a rod 160*b* which is positioned in the channel member 146. The rod 160*b* is provided with tapped bores for receiving bolts 162—162 carried by the upper leg 164*a* of a stop carrying member 164, the downwardly extending leg 164*b* of which engages the inner side wall of the channel member 146.

Referring, now, to FIGS. 25–27 of the drawings, a movable bottom chord guide pin 170 is shown mounted on the channel member 12*d* secured to the inner side wall 12*c* of the rail 12, inwardly of the unit 140 carried on the rail 12. A similar pin is mounted on the other rail 12. The pin 170 is secured to a plate 172 provided with a pair of bolts 174—174 in threaded engagement with a clamp bar 176 carried in the channel member 12*d*. The pin 170 aids in maintaining the end of the bottom chord 178 in abutting relation to the side of the top chord 180 as shown in dotted lines in FIG. 25.

In FIGS. 28 and 29, there is illustrated a top chord rail positioning rod assembly 190 which is mounted on the bottom chord rail 10 adjacent to where the rails 10 and 12 intersect. The assembly 190 comprises a base plate 192 which overlies the top wall 10*a* of the rail 10. Secured to the outer edge of the plate 192 are a pair of spaced, downwardly extending projections 194—194 adapted to be received in spaces 10*e* between the bosses or teeth 10*f* on the side wall 10*b* of the rail 10. The inner edge of the plate 192 has a pair of spaced, downwardly extending projections 196—196 which engage the outer surface of the side wall 10*c* of the rail 10. Mounted on the plate 192 is bearing member 198 in which is supported a rod 200 having a flat rounded head 200*a* at one end thereof which is adapted to engage the wall 12*e* of the rail 12. The other end of the rod 200 is provided with a handle 202 pivotally connected by a pin 204 to a locking arm 206 having an elongated opening 206*a* at the inner end thereof which is in engagement with a pin 208 carried by the rod 200. Movement of the handle 202 in the direction of the rail 12 locks the head 200*a* and prevents the rail 10 from moving inwardly in relation to the rail 10.

As best illustrated in FIGS. 1 and 2, the fastening means embedding station, or station 2 of the system, includes a pit 220, and press rollers 222—222 positioned adjacent to, and down-line with respect to the pit 220. The pit 220 has a stairway 220*a* at one end thereof, and is provided with an elongated, spring biased, foot-operated control rod or bar 224 extending along the rear wall of the pit 220. The pit 220 is long enough and wide enough to enable an operator to reach all of the joints between the wood members comprising a truss, and the control rod 224 can be operated from any position in the pit 220 by either foot of the operator. The control rod 224 is connected to a switch which energizes a motor 226 by means of which the press rollers 222—222 are driven. In the pit 220, an operator loosely embeds lower nail plates at the joints formed by the wood members in opposed relation to the upper nail plates which were loosely embedded at the joints at station 1. As the lower nail plates are embedded by the operator, the truss is progressively drawn between the rollers 222—222 when the operator intermittently and selectively energizes the motor 226 by depressing the foot operated control rod 224. Control levers 228—228, one of which can be operated from the pit 220, are provided to enable the operator to reverse the rotation of the press rollers 222—222 whenever necessary. Also provided are safety bars 230—230 on each side of the rollers 222—222. The bars 230—230 de-energize the motor 226 whenever they are moved in the direction of the rollers thereby preventing an operator from coming into contact with the rollers . The rollers 222—222 act to securely anchor and embed the upper and lower nail plates in the wood members comprising the truss.

As the finished truss 238 emerges from between the rollers 222—222 on the side thereof opposite to that on which the pit 220 is located, it moves onto a conveyor 240 positioned at station 3 of the system. The conveyor 240 comprises a plurality of spaced rollers 242, at least some of which are driven by chains 244—244 mounted on sprockets 246—246 connected to the shaft of one or more motors 248. The finished truss 238 is moved along the conveyor 240, while still in a horizontal position, until the leading end or tail of the truss 238 makes contact with a trip switch 250 positioned at the end of the conveyor 240. The switch 250 acts to both de-energize the motors 248 which drive the rollers 242 and to energize a motor 252. The shaft of the motor 252 is connected to one end of a cam 254, while the other end of the cam 254 is connected to a rotatable arm 256. The arm 256, in turn, is secured to a rod 258 to which is attached a plurality of truss engaging fingers 260 positioned between the rollers 242 of the conveyor 240. Upon energization of the motor 252 by the switch 250, the fingers 260 engage the truss 238 and lift it through an angle of approximately 110° onto truss stacking members 262. As the cam 254 completes its 360° revolution, the fingers 260 are returned to their position between the rollers 242.

The stacking members 262 at the station 3 are provided with upwardly extending truss supporting fingers 264. The base of each of the fingers 264 is connected to a motor driven chain 266, and moves along a slot **262*a* provided in the top wall of the members 262. Each chain 266 is mounted on a common shaft, and moves a predetermined distance in response to the upward movement of the fingers 260. When a complete complement of finished trusses has been stacked on the members 262, and the fingers 264 have reached the end of the slot 262*a*, a microswitch (not shown) is opened, and further movement of the chains 266 is prevented. The finished trusses then are bound together, as by wire strapping, and removed from the members 262 by means of a forklift truck, or the like. The fingers 264 thereafter are returned to their original position at the inner end of the members 262** by means of a hand crank (not shown), ready for another truss stacking operation.

As stated hereinabove, only two operators are needed to produce a complete truss with the apparatus of the present invention. The wood members used in forming the truss are precut and stacked at the station 1 within easy reach of one of the operators. As viewed in FIGS. 1 and 2, one of the operators is positioned along the outer edge of the bottom rail 10, while the other operator is positioned alongside the bridge 18 at the hinged inner ends of the top chord rails 12—12. The pre-cut wood members are stacked near the operator positioned along the rail 10, and it is his task, with the aid of the other operator when necessary, to place the wood members which form the top chords **238*a*—238*a*, the bottom chord 238*b* and the struts or webs 238*c* on the top and bottom rails 10 and 12 so that the joints between the wood members abut each other snugly and properly. Each operator, using a pressurized air, or pneumatic gun, for example, provided with a clip for holding fastening means, such as corrugated fasteners, then fixes the joints in position. At the same time each operator loosely anchors upper nail plates, as exemplified by the plates 270 and 272 in FIGS. 9 and 19, across the joints formed by the wood members within his reach. Initial anchoring of the plates can be carried out with the pneumatic guns used to secure the corrugated fasteners in the joints of the wood members. In this connection, it should be pointed out that it is only necessary to embed a few of the nails protruding from each nail plate in the wood members to achieve initial anchoring. After the upper nail plates are in position on the wood members, the operator positioned along the bottom chord rail 10 releases the air valve 130 which simultaneously operates the main air cylinder 80 and the auxiliary air cylinder 120. The rod 74, connected to the piston of the cylinder 80 drives the rollers 60, positioned under the struts 238*c* of the truss, and the rollers 90 underlying the bottom chord on the support members 92 and 94, upwardly, as shown in FIGS. 8 and 12. At the same time the roller ball 120*b* on the piston 120*a* of the cylinder 120 moves upwardly into engagement with one of the top chords of the truss. As a result, the wood members are elevated, as a unit, and pushed by the operators to station 2. In this connection, it should be pointed out that the rollers 60 on the bridges 16 which are down-line from the top chord rail 12, on the right as viewed in FIG. 1, are also elevated by the rod 74 thereby forming a conveyor for the truss as it travels in a horizontal position to station 2**.

At station 2, the operator who was initially positioned along the top chord rails 12—12, moves into the pit 220 where the lower nail plates are anchored in the joints of the wood members as the operator progressively feeds the truss between the press rollers 222—222 by the action of his foot on the control rod 224. A pneumatic gun, again, advantageously is used by the operator to anchor the lower nail plates in the joints at station 2. After the completed truss 238 leaves station 2, it moves onto the conveyor 240 at station 3, and is stacked as described previously hereinabove.

Also, as stated hereinabove, the apparatus of the present invention can be used to fabricate substantially any kind of a wood truss. In the case of one such truss, namely, a scissors truss, no bottom chords, as such, are used. In utilizing the apparatus at station 1 of the system to make a scissors truss, the top chord rails 12—12, as shown in FIGS. 1 and 6, are employed to fix the dimensions of the truss, and serve to support the ends, or tails, of the truss. The wood members forming the upper chords of the scissors truss are supported on a second, shorter pair of hinged top chord rails 280—280, also desirably fabricated of steel channel beams. The hinge elements **280*f* at the inner ends of the rails 280—280 are positioned on the bridge 18** in a manner to place the bolt 282 on the inner, or bottom chord rail 10 facing side of the rails 280—280, and the upwardly extending wood member positioning wall 280*e* of the rails 280—280 is on the inner side thereof. This arrangement enables all of the wood members comprising the scissors truss to be properly positioned with respect to each other on the rails 280—280 and 12—12. Initial fixing of the joints of the truss, and anchoring of the top nail plates, are carried out as described above.

While for purposes of illustration one form of the present invention has been described, other forms thereof may become apparent to those skilled in the art upon reference to this disclosure and, therefore, this invention is to be limited only by the scope of the appended claims.

What is claimed is:

1. An in-line system for making a wood roof truss, or the like, comprising: a wood member positioning station including wood member support means for arranging wood members in positions corresponding to the ultimate positions of the wood members in a completed wood roof truss or the like, and for partially securing upper fastening means at each of the abutting portions of the wood members to initially fix said wood members in their ultimate positions, said station further including wood member engaging and elevating means for raising the partially secured wood members as a unit above the plane of the wood member support means whereby the initially fixed wood members can be advanced in a predetermined direction, a fastening means securing station down line from said positioning station in said predetermined direction for partially securing lower fastening means at the abutting portions of the wood members in opposed relation to the upper fastening means partially secured at each of said abutting portions of the wood members, a fastening means embedding station down line from said securing station in said predetermined direction for permanently anchoring the upper and lower fastening means in the wood members, and a wood roof truss stacking station down line from said embedding station in said predetermined direction for automatically moving a completed roof truss out of the path of travel of succeeding trusses as each truss leaves the nail embedding station.

2. An in-line system according to claim 1 wherein the wood member support means includes a bottom chord rail and a pair of adjustable top chord rails, said rails providing a framework for positioning the wood members comprising a wood roof truss, or the like.

3. An in-line system according to claim 2 wherein movable bottom chord support members are provided for the bottom chord rail for supporting the wood members forming the bottom chord of a truss, or the like, in a horizontal plane substantially the same as that in which the wood members forming the top chords of the truss, or the like, lie.

4. An in-line system according to claim 1, wherein the wood member engaging and elevating means includes a plurality of rollers mounted on spaced, substantially parallel bridges extending laterally from the bottom chord rail.

5. An in-line system according to claim 1, wherein the lower fastening means securing station includes a pit area for enabling an operator to partially embed fastening means in the wood members while the initally fixed wood members are in a substantially horizontal position.

6. An in-line system according to claim 5, wherein the pit area is provided with control means for enabling an operator to progressively move the fixed wood members into the fastening means embedding station of the system.

7. An in-line system according to claim 1, wherein the fastening means embedding station comprises a roller press for anchoring the upper and lower fastening means in the wood members.

8. An in-line system according to claim 1, wherein the stacking station includes conveyor means for moving a completed wood roof truss, or the like, from the fastening means embedding station to truss elevating and stacking means at the stacking station.

9. An in-line system according to claim 8, wherein the truss elevating and stacking means includes a plurality of spaced, elongated, normally substantially horizontally disposed, motor driven finger-like members which act to engage and elevate a completed truss, or the like, moving along the conveyor means, and to stack it on truss supporting means positioned out of the in-line path of travel of the completed truss, or the like.

10. An in-line system according to claim 9, wherein truss actuated switch means is provided for energizing the motor which elevates the finger-like members.

* * * * *